United States Patent [19]

Tsukamoto

[11] 3,987,558

[45] Oct. 26, 1976

[54] DEVICE FOR PRODUCING A BLOCK-BUILT PICTURE

[76] Inventor: Shouji Tsukamoto, 10-14, Daikanyama, Shibuya, Tokyo, Japan

[22] Filed: June 19, 1972

[21] Appl. No.: 264,287

[30] Foreign Application Priority Data

| | | |
|---|---|---|
| June 18, 1971 | Japan | 46-51652 |
| June 18, 1971 | Japan | 46-51653 |
| Sept. 8, 1971 | Japan | 46-80949 |

[52] U.S. Cl. ..... 35/27; 273/157 R; 46/16

[51] Int. Cl.[2] ..... G09B 1/10

[58] Field of Search ..... 35/26, 27, 28; 273/146

[56] References Cited

UNITED STATES PATENTS

| | | | |
|---|---|---|---|
| 61,531 | 1/1867 | Freetsha | 35/27 |
| 1,492,671 | 5/1924 | Bruel | 35/27 |
| 1,777,622 | 10/1930 | O'Hare | 197/1 R |
| 2,280,609 | 4/1942 | Williamson | 35/28 X |

OTHER PUBLICATIONS

Dyna–Slide Co., Advertisement p. 60 of May 1968, The Science Teacher.

*Primary Examiner*—Harland S. Skogquist
*Attorney, Agent, or Firm*—Haseltine, Lake & Waters

[57] ABSTRACT

A device for producing a block-built picture comprising a plurality of blocks and a support for mounting the blocks in a regular arrangement along coordinate axes. The blocks are adapted to present varying pictoral elements of at least one area thereof to define a picture perceived by the areal density of the pictoral elements. Thereby a block-built picture is produced by properly selecting the area of the pictoral elements of respective position of cubic blocks or changing the rotational position of cylindrical blocks.

1 Claim, 40 Drawing Figures

DEVICE FOR PRODUCING A BLOCK-BUILT PICTURE

BACKGROUND OF THE INVENTION

1. Field of the Invention

This invention relates to a device for producing a block-built picture usable as a mural or an interior decoration, said device being adapted to be readily operated by an amateur to produce a picture according to his own originality or a given program or to vary a present picture as he likes.

2. Description of the Prior Art

It is conventionally known in the art to produce a picture by means of tile pieces having various shapes of regular or irregular contours and/or colors. Those conventional tile-built pictures which belong to products of art generally require an aesthetic sense as well as a technological skill of a relatively high level, and therefore, it is difficult for an amateur to produce them, or in other words, the conventional tile-built pictures can not be a hobby to be conveniently enjoyed by the majority of people.

There is also conventionally known a product which includes tile pieces of various shapes of regular or irregular contours and/or colors preliminarily arranged to provide a picture or pattern, each tile piece being adhered to a sheet of paper, said product being adapted to be mounted to the surface of a wall or floor by mortar to instantly provide a tile-built wall or floor of an aesthetic character. However, the mounting process also requires a technological skill higher than a common level. Furthermore, it is a common drawback of the conventional tile-built arts that they are generally permanent as a part of a building and can not be readily changed even when they have lost the interest of appreciative or capricious people.

SUMMARY OF THE INVENTION

Accordingly, it is an object of this invention to provide a device for producing a block-built picture which allows for an amateur to conveniently enjoy the production of a block-built picture with no difficulty regarding the technological skill and with a lower bar regarding the aesthetic sense.

Another object of this invention is to provide a device for producing a block-built picture which allows to readily vary the picture according to changes of the taste of the users.

A further object is to provide a device for producing a block-built picture adapted to produce a picture by pictoral elements carried by blocks, said pictoral elements being variant of at least area thereof.

Still another object is to provide a device for producing a block-built picture adapted to allow change of the picture with no spare block.

Still a further object is to provide a device for producing a block-built picture adapted to provide a picture having a relief characteristic.

Still a further object is to provide a device for producing a block-built picture adapted to provide coloration of picture by a mixing of colored pictoral elements carried by adjacent blocks. BRIEF DESCRIP-

BRIEF DESCRIPTION OF THE DRAWING

In the accompanying drawing,

FIGS. 4 to 13 show several embodiments of the device according to this invention, particularly the manner of mounting blocks as shown in FIG. 2, wherein FIGS. 5, 7, 9, 11 and 13 are partial front views and FIGS. 4, 6, 8, 10 and 12 are sectional views along lines IV—IV, VI—VI, VIII—VIII, X—X and XII—XII in FIGS. 5, 7, 9, 11 and 13, respectively.

FIGS. 18 to 21B show other several embodiments of the device or the blocks according to this invention, particularly the manner of providing the pictoral element of the block, wherein FIGS. 18 and 20 show a series of plan views of two groups of blocks and FIGS. 19A–19D and FIGS. 21A and 21B show sectional views along lines XIX—XIX and XXI—XXI in FIGS. 18 and 20, respectively, about several embodiments;

FIGS. 22 to 25 show an embodiment of the means for mounting the blocks shown in FIGS. 18 to 21B, wherein FIG. 23 is a section along line XXIII—XXIII in FIG. 22 and FIG. 24 is a section along line XXIV—XXIV in FIG. 25;

FIGS. 26 and 27 show another embodiment of the means for mounting the blocks shown in FIGS. 18 to 21B, wherein FIG. 26 is a section along line XXVI—XXVI in FIG. 27.

DESCRIPTION OF THE PREFERRED EMBODIMENTS

This invention will now be described more particularly of some preferred embodiments with reference to the accompanying drawing.

Figure 1:
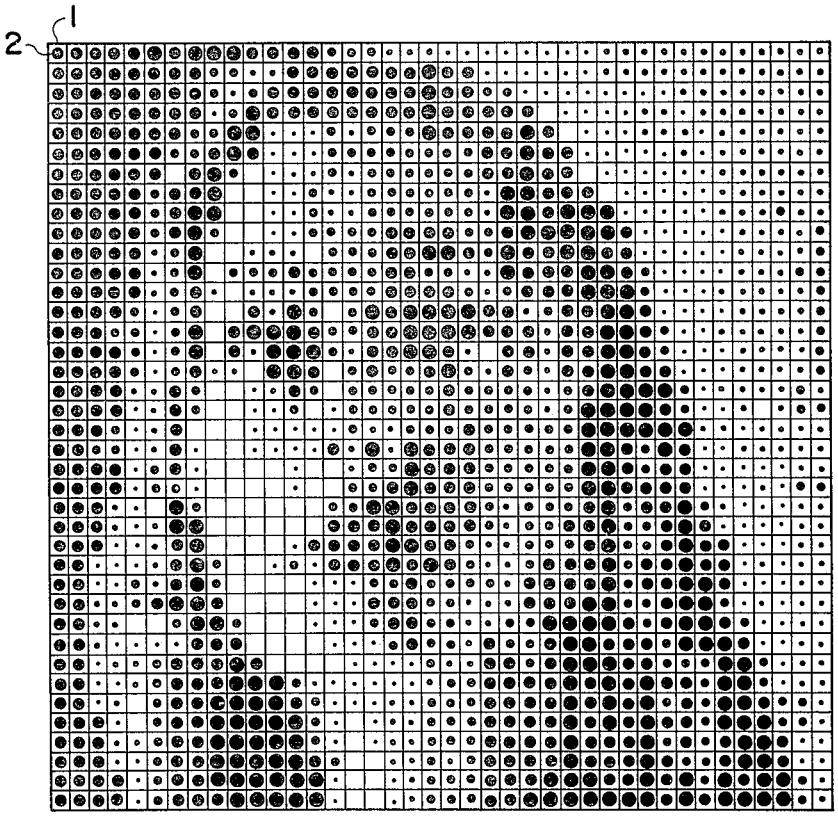
FIG. 1 shows an example of the block-built picture produced by an embodiment of the device according to this invention.
Figure 2:
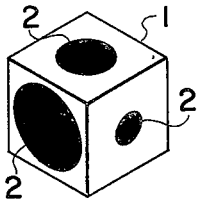
FIG. 2 shows an example of a block used to produce the picture shown in FIG. 1.
Figure 3:
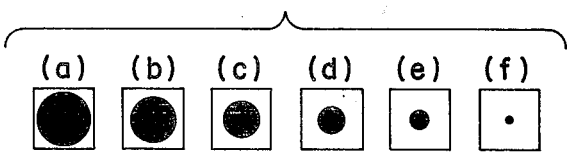
FIG. 3 shows respective faces of the block shown in FIG. 2.

FIG. 1 shows an example of the block-built picture produced by an embodiment of the device according to this invention. This picture is built of blocks 1 each having a pictoral element 2 of an observative area selected from several different areas. In the picture shown in FIG. 1, the pictoral elements are circular colored portions of six different observative areas provided on the faces of the blocks. Such six different pictoral elements can be provided by each one block of cubic shape as shown in FIG. 2. The cubic block 1 shown in FIG. 2 has six faces each carrying a particular one of the six pictoral elements and can present any one of the six different faces *a* to *f* as shown in FIG. 3 according to the direction of mounting thereof.

FIGS. 4 to 13 show several embodiments of the device for producing a block-built picture employing the cubic blocks as shown in FIG. 2, wherein it is particularly shown how the cubic blocks are rearrangeably assembled to produce a picture, the pictoral elements being omitted for the purpose of clarity.

Figure 4:
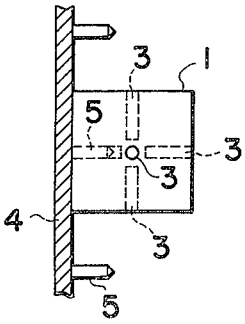
Figure 5:
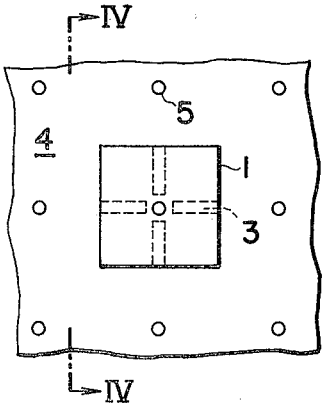

In the embodiment shown in FIGS. 4 and 5, each face of the cubic block 1 is provided with a bore 3 at the central portion thereof, while a board 4 adapted to support the blocks is provided with pins 5 arranged uniformly spaced along rectangular coordinates. By the engagement of the pin 5 and any one of the six bores 3, the block 1 is mounted on the board to present any selected one of the six pictoral elements carried by the block.

Figure 6:
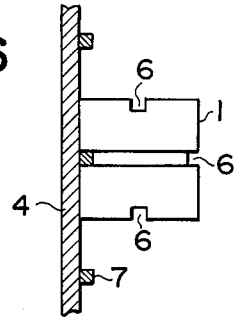
Figure 7:
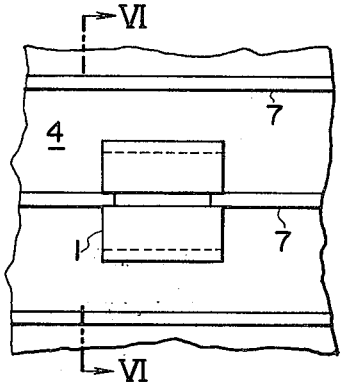

In the embodiment shown in FIGS. 6 and 7, each face of the cubic block 1 is provided with a groove 6 extending in parallel with a side edge thereof through the central point thereof, while the board 4 is provided with a series of parallel ribs 7 adapted to engage the grooves of the blocks.

Figure 8:
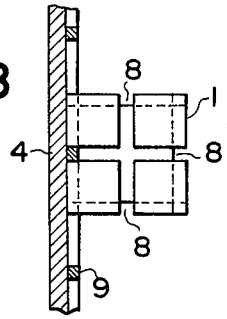
Figure 9:
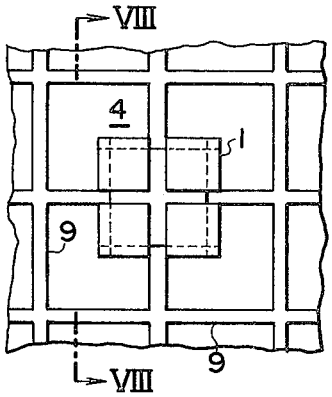

In the embodiment shown in FIGS. 8 and 9, each face of the block 1 is provided with two perpendicularly crossing grooves 8 extending parallel with the side edges thereof through the central point thereof, while the board 4 is provided with a series of parallel and perpendicularly arranged ribs 9. The block 1 is mounted on the board by the cross grooves 8 being engaged with one of the crossing regions of the perpendicularly extending ribs.

Figure 10:
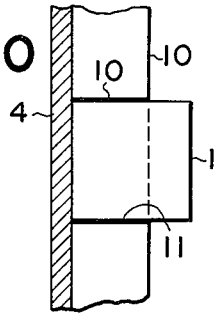
Figure 11:
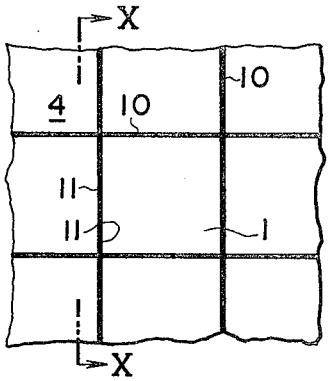

In the embodiment shown in FIGS. 10 and 11, the block 1 is provided with no particular mounting means, while the board 4 is provided with thin ribs 10 forming spaces 11 arranged like a checkerboard. The block 1 is held in an assembled position by being inserted into the holding space.

Figure 12:
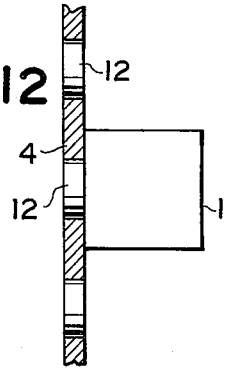
Figure 13:
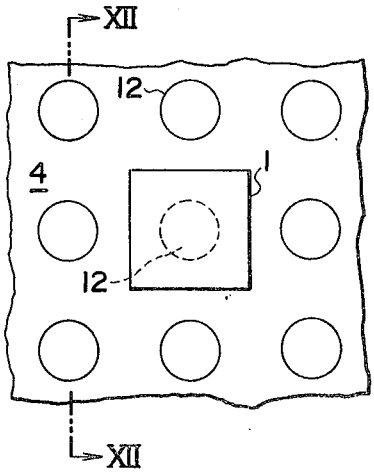

In the embodiment shown in FIGS. 12 and 13, the block 1 or at least each face portion thereof is made of wrought iron, while the board 4 is provided with magnet pieces 12. The block 1 is magnetically held in an assembled condition.

Figure 14:
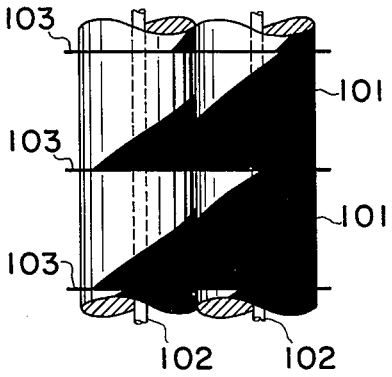
FIG. 14 shows another embodiment of the device according to this invention in a partial front view.

FIG. 14 shows another embodiment of the device for producing a block-built picture according to this invention. In this embodiment, the block is formed as a cylindrical block 101, which is arranged closely adjacent with other blocks along rectangular coordinates. Each block 101 is supported by a fixed shaft 102 to be freely rotatably thereabout, and is isolated from vertically adjacent ones by thin plates 103 so that rotation of one cylindrical block does not cause rotation of the other. The cylindrical surface of the block 101 is provided with a pictoral element 104 as shown in FIG. 15 in development thereof, which is a taperingly colored portion adapted to present a gradually different observative area according to the rotational position of the cylindrical block.

Figure 15:
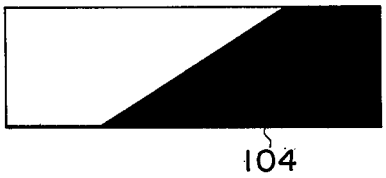
FIG. 15 shows the development of the cylindrical surface of the block used in the device shown in FIG. 14.
Figure 16A:
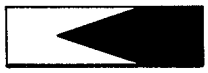
FIGS. 16A, 16B, 16C and 16D show several variations of the pictoral condition of the cylindrical surface of the block shown in FIG. 14.
Figure 16B:
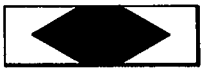
Figure 16C:
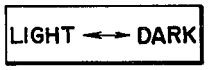
Figure 16D:
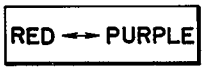

FIGS. 16A to 16D show several variations of the cylindrical surface, wherein the variations of FIGS. 16A and 16B provide a substantially same effect as that shown in FIG. 15. The variation of FIG. 16C provides pictures of a little different character. The embodiment of FIG. 15 and the variations of FIGS. 16A, 16B and 16C should generally provide monochromatic pictures. In contrast to these embodiments, the variation of FIG. 16D provides different colors according to different rotational positions of the cylindrical block, whereby the device constructed according to the variation of FIG. 16D provides a colored picture due to a mixing of the different colors presented by the respective cylindrical blocks according to selected rotations thereof.

Figure 17:
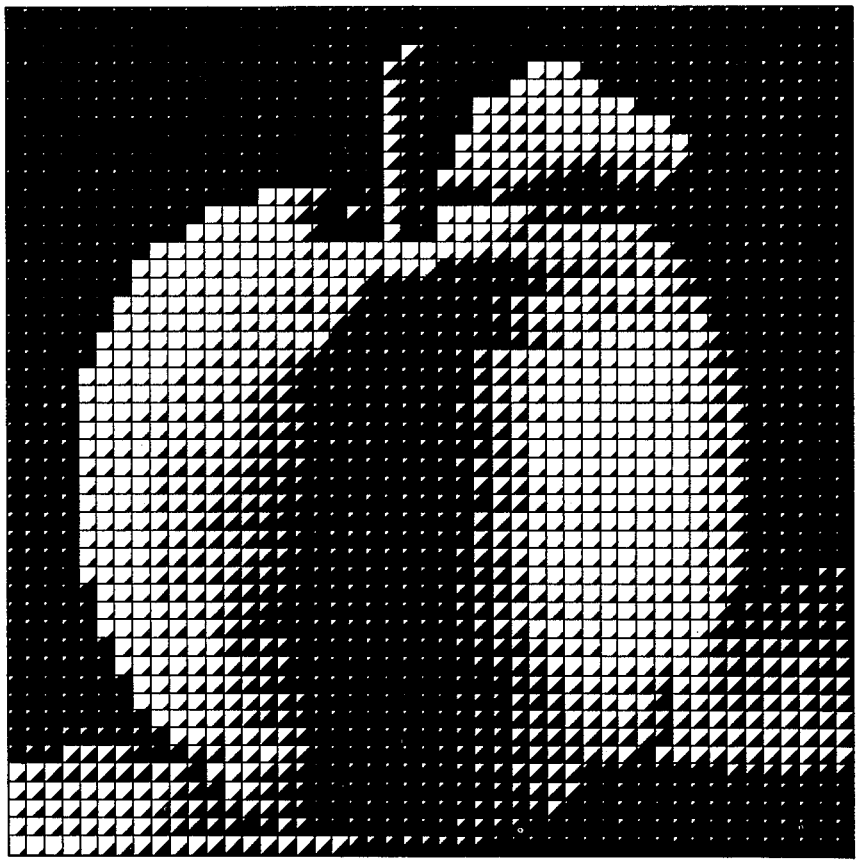
FIG. 17 shows an example of the picture produced by the device shown in FIG. 14.

FIG. 17 shows an example of the picture produced by the device shown in FIG. 14.

FIGS. 18 to 21B show other several embodiments of the device according to this invention, particularly the manner of providing the pictoral element of the block which can provide pictures having relief characteristics. These blocks 201 have shapes preferably formed by a pressing process of metal sheet or an extrusion process of thermoplastic resin.

Figures 18, 19A, 19B, 19C, 19D:
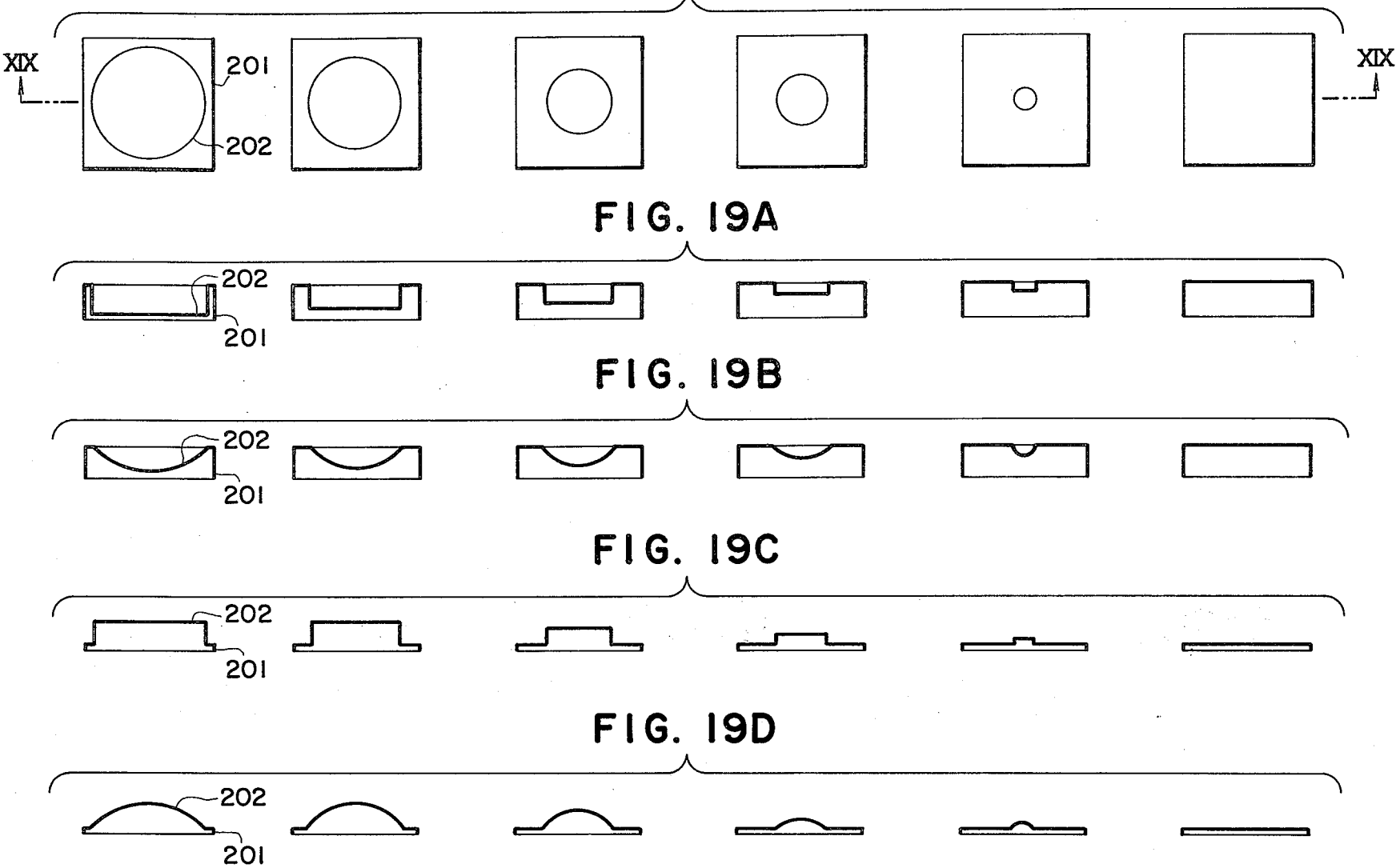
Figure 20:
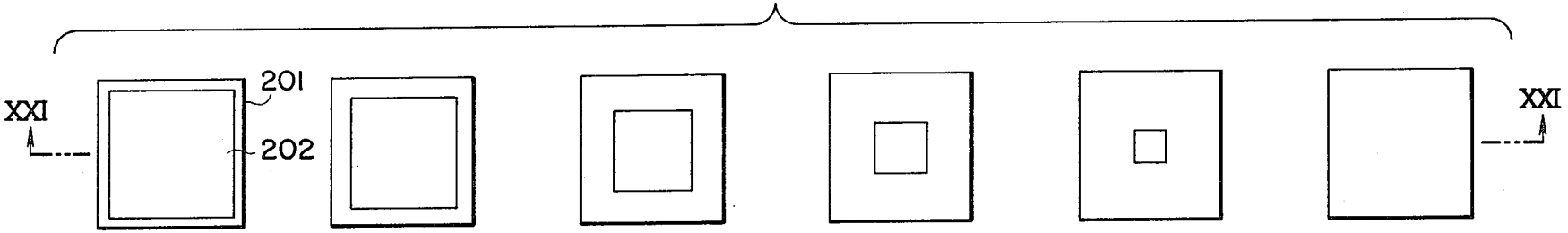
Figure 21A:
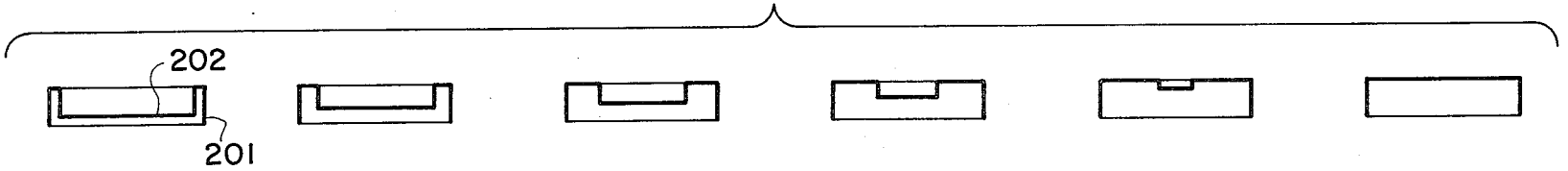
Figure 21B:
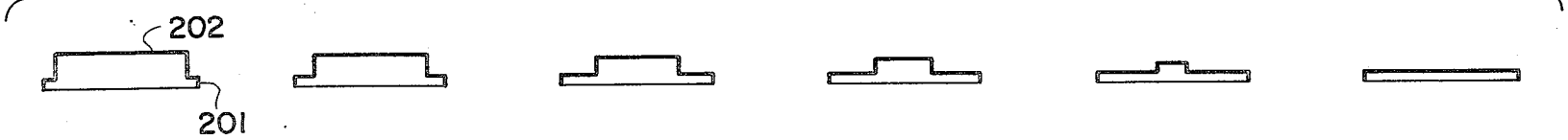
Figure 22:
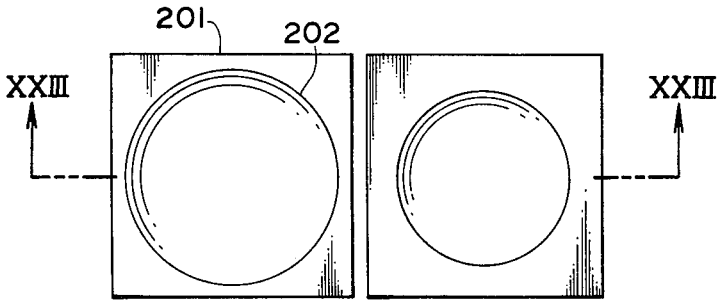
Figure 23:
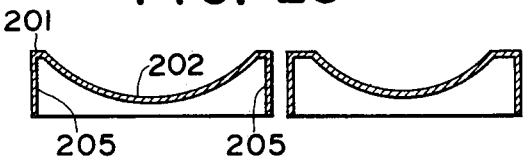

Referring to FIGS. 19A–19D and FIGS. 21A and 21B, the blocks of the series of FIG. 19A, FIG. 19B and FIG. 21A are of the kind wherein the pictoral elements 202 are sunken from the faces of the blocks, while the blocks of the series of FIG. 19C, FIG. 19D and FIG. 21B are of the kind wherein the pictoral elements are elevated from the faces of the blocks. In the embodiments shown in FIGS. 19A–19D and FIGS. 21A and 21B, the depth of the sunken portion or the height of the elevated portion is gradually reduced corresponding to the areas of the sunken or the elevated portion so as to generally reasonably provide a relief characteristic of the picture formed by these blocks, but the depth or the height of the sunken or the elevated portion may be selected otherwise to provide any particularly desired relief characteristic.

Figure 24:
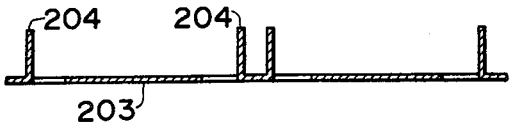
Figure 25:
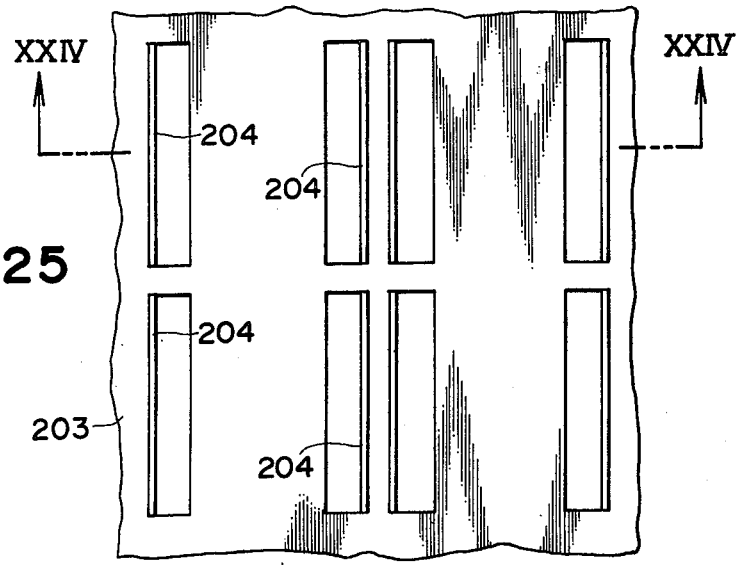

FIGS. 22 to 25 show an embodiment of the means for mounting the blocks shown in FIGS. 18 to 21B, but by taking the blocks 201 of FIG. 19B as an example. In FIGS. 24 and 25, 203 designates a sheet which is formed with projected lips 204 by being cut at proper portions thereof and bent at the cut portions. The lips 204 are formed to provide pairs of lips, each pair being adapted to receive one block by frictionally contacting with opposite inner side surfaces 205 of the block.

Figure 26:
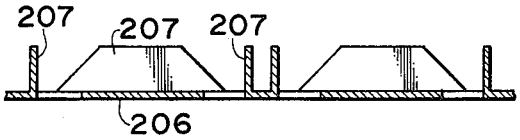
Figure 27:
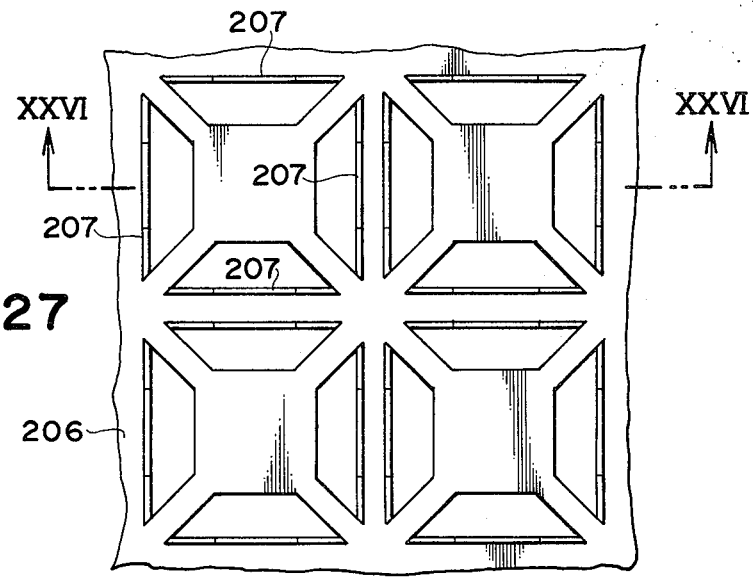

FIGS. 26 and 27 show another embodiment of the means for mounting the blocks shown in FIGS. 18 to 21B. In this case a metal sheet 206 is formed with cut-up lips 207 adapted to provide each set of block mounting means by four.

It will be appreciated that the block mounting means shown in FIGS. 24 to 27 are produced at a very low cost by one step punching of metal sheets.

FIGS. 28A and 28B, FIGS. 29A and 29B and FIGS. 30A and 30B show still other embodiments of the device or the blocks for producing a block-built picture according to this invention whereby colored pictures are produced.

Figure 28A:
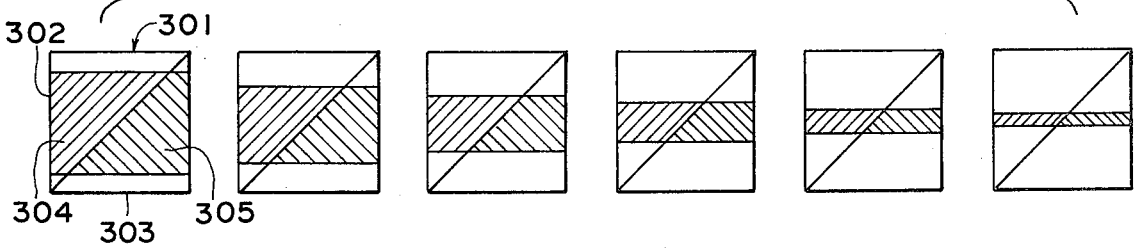
FIGS. 28A to 30B show still other embodiments of the device or the blocks according to this invention adapted to produce colored pictures.
Figure 28B:
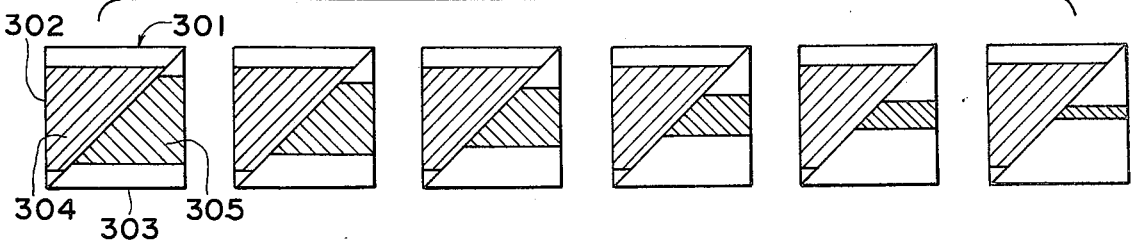

Each block 301 shown in the series of FIGS. 28A and 28B is assembled of two triangular halves 302 and 303. The triangular halves 302 are provide with colored strips 304 of a color selected from three primary colors, while the triangular halves 303 are provided with colored strips 305 of another color selected from the three primary colors. By the combinations of the triangular halves 302 and 303 as shown in the series of FIG. 28A, assuming that the color of the strips 304 is red and the color of the strips 305 is yellow, all combinations of the series may be usable as blocks of various areal graduations of green pictoral element. By the combination of the triangular halves 302 and 303 as shown in the series of FIG. 28B, assuming the same color contrast of the strips 304 and 305 as in the series of FIG. 28A, the hallucianatorily perceived color of the blocks changes from green to red as the combination transfers from left one to right one in FIG. 28B.

Figure 29A:
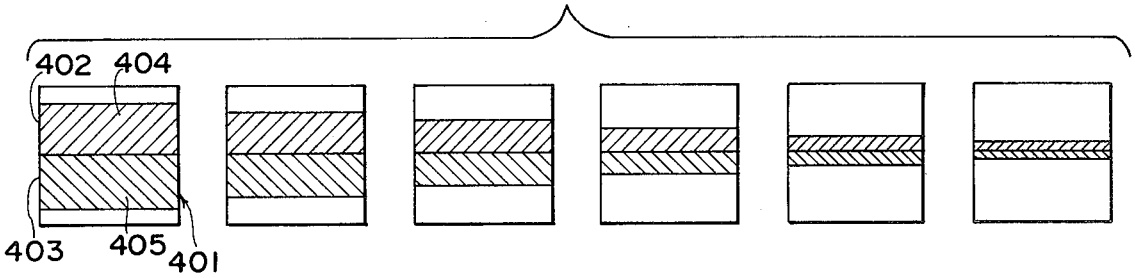
Figure 29B:
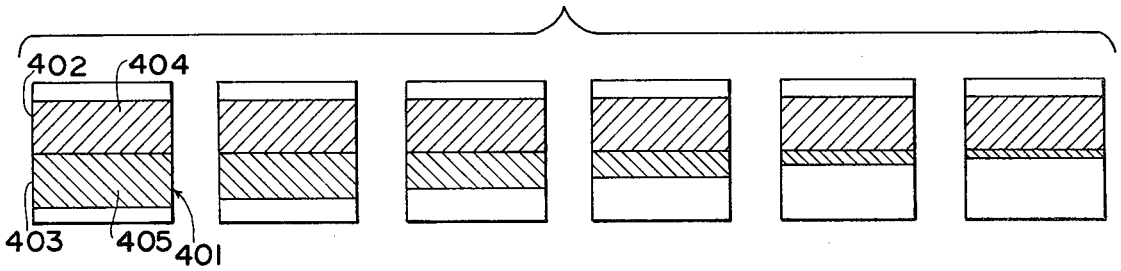
Figure 30A:
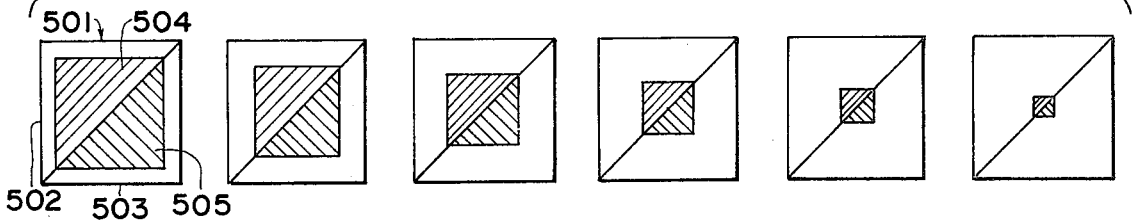
Figure 30B:
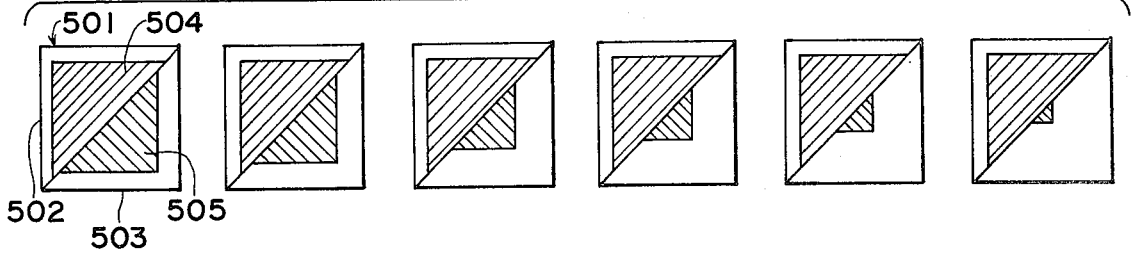

The same effects as obtained by the blocks of the series of FIGS. 28A and 28B are obtained by the blocks of the series of FIGS. 29A and 29B or FIGS. 30A and 30B, wherein the blocks 401 of FIGS. 29A and 29B are assembled of two rectangular halves 402 and 403 having colored strips 404 and 405, respectively, while the blocks 501 of FIGS. 30A and 30B are assembled of two triangular halves 502 and 503 having colored triangular portions 504 and 505, respectively.

The blocks 301, 401, and 501 may be preliminarily assembled of two selected halves removably adhered together by suitable means (not shown), or they may be assembled of two selected halves each independently mounted to block mounting means adapted to independently support each one of those halves.

I claim:

1. A device for producing a block-built picture comprising a plurality of blocks and block mounting means for supporting said blocks in a regular arrangement along coordinate axes, said blocks being provided with pictoral elements of a common shape but varying in at least the area thereof to define, upon being mounted in said block mounting means, a picture adapted for being perceived by the areal density of said pictoral elements, said block mounting means comprising a board, said board and blocks including and being provided with pins and bores, said blocks being adapted to be removably mounted on said board by engagement of said pins and bores, said pins being carried by said board and arranged regularly along rectangular coordinates, said blocks each being formed with said bores at respective faces thereof, said blocks being cubes each with six different observation faces having respectively different pictoral elements.

* * * * *